United States Patent [19]

Turczanski

[11] 4,363,011

[45] Dec. 7, 1982

[54] CONTACT ELECTRODES FOR REED SWITCHES

[76] Inventor: Henryk Turczanski, 17a Reddons Rd., Beckenham, Kent, England

[21] Appl. No.: 242,536

[22] Filed: Mar. 11, 1981

[30] Foreign Application Priority Data

Mar. 17, 1980 [GB] United Kingdom ..... 8008912

[51] Int. Cl.[3] ..... H01H 51/00; H01H 1/66

[52] U.S. Cl. ..... 335/154; 335/151

[58] Field of Search ..... 335/154, 151, 153

[56] References Cited

FOREIGN PATENT DOCUMENTS 1117761 11/1961 Fed. Rep. of Germany ..... 335/154

382161 8/1973 U.S.S.R. ..... 335/154

*Primary Examiner*—Harold Broome

*Attorney, Agent, or Firm*—Shapiro and Shapiro

[57] ABSTRACT

A reed switch having contact electrodes extending within a sealed envelope to overlap and form a magnetically actuable contact gap of the switch.

Each contact electrode has flattened bladed portions which taper from their overlapping forward extremities to form blades of varying thickness, the thickest part of the blades being at the overlap between them.

2 Claims, 2 Drawing Figures

CONTACT ELECTRODES FOR REED SWITCHES

TECHNICAL FIELD OF THE INVENTION

The present invention relates to a reed switch having contact electrodes formed from a length of magnetisable material which is flattened over a part of its length to provide a flexible cantilevered blade portion of the electrode.

BACKGROUND ART

Contact electrodes as used for reed switches consist in general, of a length of ferromagnetic wire which is flattened over a part of its length to form a flexible cantilever or blade.

Two of these electrodes are sealed into a glass tube with the blades overlapping within the tube. The overlapping ends are positioned to form a small gap which can be opened and closed by the action of an externally applied magnetic field.

It is desirable to make the gap between the blades as large as possible to enable the switch to handle high electrical power and to provide long operational life. For any one size of the contact electrodes the maximum gap between the blades is limited by magnetic saturation of the ferromagnetic material used. Also the separation between the blades cannot be increased too much by making the blades more flexible without upsetting the dynamic characteristics of the switch. If the blades are made too flexible the bounce time on closure may become prohibitively long. The duration of bounce depends primarily on the resonant frequency and the damping characteristics of the contacting blades.

DISCLOSURE OF THE INVENTION

It is an object of the invention to provide a reed switch having contact electrodes provided with switch blades which permit the largest possible gap to be formed between opposing surfaces of the electrodes with optimum damping characteristics.

According to the invention there is provided a reed switch comprising an hermetically sealed enclosure, and a pair of electrodes extending within the enclosure, each electrode having length, width and thickness and being flattened over a part of its length to provide respective flexible cantilevered electrode blade portions with free ends having an overlap region extending in the length and width directions within said enclosure to form a magnetically actuable contact of said switch, characterised in that the flattened length of each electrode has a tapered thickness to provide an electrode blade portion of uniformly varying thickness, with the thickest part being at free end thereof.

Contact electrodes of this form provide several improvements over blades of uniform cross-section. Thus increased separation between the blades in the enclosure of the reed switch is possible without increasing the bounce time.

Further, damping characteristics are improved due to an increase in the moment of inertia in the area of contact, this in turn providing higher impact forces in the contact area.

Finally it is possible to improve the lateral alignment between the blades in the reed switch due to the possibility of introducing smaller blade width in the overlap area.

BRIEF DESCRIPTION OF THE DRAWINGS

An embodiment of the present invention will now be described by way of example with reference to the accompanying drawings wherein.

BEST MODES OF CARRYING OUT THE INVENTION

Figure 1:
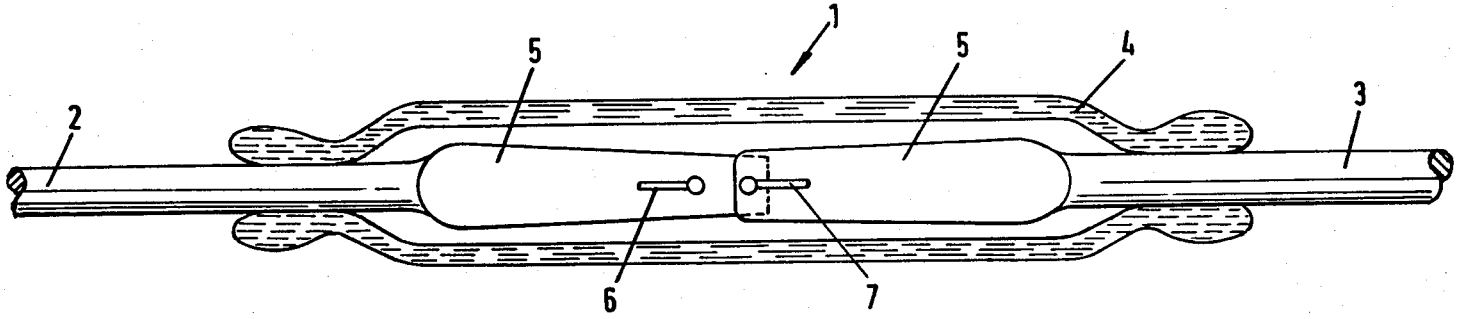
FIG. 1 shows a cross-sectional plan view of a reed switch employing a pair of contact electrodes according to an embodiment of the invention.
Figure 2:
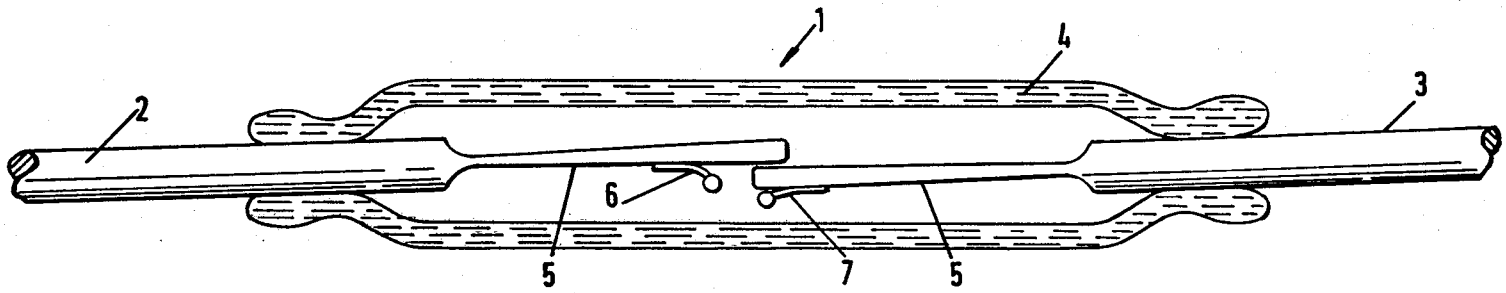
FIG. 2 shows a side cross-sectional view of the reed switch of FIG. 1.

The reed switch shown in FIGS. 1 and 2 comprises a pair of electrodes 2 and 3 made of a ferromagnetic material, extending within an hermetically sealed glass enclosure or envelope 4.

The ends of the electrodes within the envelope 4 are flattened to form spaded cantilevered contact blades 5. The blades 5 overlap one another within the envelope 4 as shown, and a contact gap is provided between the overlapping portions.

As will be seen from FIG. 2 the contact blades 5 are tapered from their forward extremities to form blades of varying thickness, the thickest part of the blades being at the overlap between them. Since the blades 5 are pressed out of the round wire with a tapering thickness as described, they assume the configuration shown in FIG. 1 with the base of the blade being wider than the tip.

Attached to the lower surfaces of each blade 5 are two straps 6 and 7. These straps are formed from a single connecting piece which during manufacture joins the blades together. Two connected electrodes 2 and 3 are then sealed in the glass enclosure 4 and an electric current is passed between the electrodes 2 and 3 to fuse the connecting strap leaving the two strap portions 6 and 7.

I claim:

1. A reed switch comprising a hermetically sealed enclosure, and a pair of electrodes extending within the enclosure, each electrode having mutually orthogonal dimensions of length, width and thickness and being flattened over a part of its length to provide respective flexible cantilevered electrode blade portions having free ends, the free ends having an overlap region within said enclosure extending in the length and width dimensions to form a magnetically actuable contact of said switch, characterised in that the blade portion of each electrode is tapered in the thickness dimension so that the thickness of the blade portion increases uniformly towards the free end.

2. A reed switch as claimed in claim 1 wherein said blade portions are pressed out of round wire so that the width dimension of said blade portions tapers to a smallest width at said free ends thereof.

* * * * *